US006796257B1

(12) United States Patent
Omohundro et al.

(10) Patent No.: US 6,796,257 B1
(45) Date of Patent: Sep. 28, 2004

(54) ZERO MOMENT FURLING SWIVEL

(75) Inventors: Thomas Omohundro, Minden, NV (US); Steve Wilson, Minden, NV (US)

(73) Assignee: Solution Inc., Minden, NV (US)

( * ) Notice: Subject to any disclaimer, the term of this patent is extended or adjusted under 35 U.S.C. 154(b) by 0 days.

(21) Appl. No.: 10/350,272

(22) Filed: Jan. 21, 2003

Related U.S. Application Data

(60) Provisional application No. 60/349,498, filed on Jan. 18, 2002.

(51) Int. Cl.[7] ..... B63H 9/10
(52) U.S. Cl. ..... 114/106; 114/107
(58) Field of Search ..... 114/104–107

(56) References Cited

U.S. PATENT DOCUMENTS 3,958,523 A * 5/1976 Holmes et al. ..... 114/106
4,057,023 A * 11/1977 Hood et al. ..... 114/107
4,526,122 A * 7/1985 Kluckhuhn ..... 114/106
4,750,879 A * 6/1988 Johnson ..... 384/609
6,318,285 B1 11/2001 Hartlmeier et al. ..... 114/106

* cited by examiner

*Primary Examiner*—Sherman Basinger
(74) *Attorney, Agent, or Firm*—Sierra Patent Group, Ltd.

(57) ABSTRACT

The disclosed device is directed toward a furling swivel mechanism comprising a liner defining a vertical centerline. An inner sleeve is disposed on the liner and the inner sleeve defines an inner sleeve recess. An outer sleeve is rotatably coupled to the inner sleeve and the outer sleeve defines an outer sleeve recess. A headsail yoke is coupled to the inner sleeve recess. A halyard yoke is coupled to the outer sleeve recess. The inner sleeve recess and the outer sleeve recess are configured to form a zero moment along the vertical centerline.

12 Claims, 4 Drawing Sheets

ZERO MOMENT FURLING SWIVEL

CROSS RELATED REFERENCES

This application claims priority to Provisional Patent Application No. 60/1349,498 filed on Jan. 18, 2002.

BACKGROUND

The present disclosure relates to swivel mechanisms for furling sails. Particularly, this disclosure relates to a lightweight swivel mechanism having a zero moment.

Sailing yachts are outfitted with equipment that enables sails to be handled easily in an automated fashion by a minimal number of crew members. Automation of the sail systems is important due to the size of the sail systems, and relatively small number of crew members. Large sailing yachts, with lengths in excess of one hundred feet, employ sailing systems which undergo dynamic load patterns and forces of considerable magnitude. The load patterns and forces are distributed throughout the sail system from the hull to the masthead. In general, the forces distributed throughout the sail system can be directly related to the square of the apparent wind velocity. Forces that a sailplane and sails resist can be estimated as the product of the squared apparent wind velocity and the total sail area of the yacht.

In conventional yacht design, the efficiency of the sail constitutes a major component of the total efficiency of a sailplane. The sail and tackle that enable the attachment of the sail to the yacht as well as the overall ability of the sail to be handled, adjusted and trimmed, must be engineered to function correctly and safely without mechanical failure.

One component within the sail system located at the top of the sail furling-luff-groove device is a sail swivel mechanism. The sail swivel mechanism is relatively small but undergoes extremely high loads. The sail swivel mechanism is a sophisticated piece of equipment located between a halyard and a head of sail, which enables automatic furling of the sail. The sail swivel mechanism prevents unwanted twisting and binding of the halyard and the head of sail as well. The clasps used to attach the head of sail to the halyard can deform or even fail through fatigue resulting from the stresses that the head of sail undergoes in combination with exposure to weather.

Since the sails aboard a yacht are so large, it is advantageous to eliminate the need to raise and lower the sails. The luff-groove mechanism is designed to rotate around a headstay for furling or unfurling the sail. The luff-groove is controlled by a furling drum and a synthetic line, or is controlled by hydraulic means having no lines and drum. The luff-groove mechanism turns the luff-groove in a clockwise or counter-clockwise direction. By the rotation of the luff-groove, the sail is driven to furl (wrap around the rotating luff-groove) or to unfurl (un-wrap from the luff-groove).

The luff-groove mechanism is often an aluminum tube or carbon fiber and epoxy laminated tube that carries a groove or tunnel on the aft side of the tube. The groove has an inside diameter of about one-quarter of an inch. The luff-groove mechanism is located and extends between the deck and the upper mast (headstay). The groove receives the sail along the length of the groove. The sail includes a rope or cylindrical section of material within the front or forward edge of the sail. The cylindrical section is inserted into the groove of the luff-groove mechanism and provides for the attachment of the sail to the luff-groove mechanism along the entire height of the luff-groove. The sail extends along its full length in the luff-groove.

The sail is raised (or lowered) in the luff-groove by a halyard to the upper section of the mast proximate to the headstay. Once the sail is raised, the sail can be furled about the luff-groove and stored until required for use. The luff-groove rotates as the sail is furled or unfurled. However, it is undesirable for the halyard to twist or rotate during the furling or unfurling process because the halyard and associated tackle can become damaged. The halyard is inhibited from rotating and twisting upon itself by the swivel mechanism, thereby preventing damage to the halyard and associated tackle.

It is thus required for the swivel mechanism to prevent the halyard from twisting and binding while maintaining resistance to the extreme forces applied to the sail during use of the sail. The extreme forces are translated from the sail to the swivel and the luff-groove. The forces are then translated to the headstay and halyard from the swivel and luff-groove. As a result of the forces through the swivel mechanism, moment arms (or simply moments) are created that place the swivel under great stress. These moments can also be translated to the luff-groove and halyard. Undue wear and ultimately failure of the components can occur as a result of the loads from the moments. Additionally, it is desirable to minimize the weight of the components above the waterline, including the components at the masthead like the swivel mechanism.

Therefore, there is a need in the sail furling art to have a swivel mechanism that is lightweight and reduces the moment applied to the components of the sail system.

SUMMARY

The disclosed device is directed toward a furling swivel mechanism. The swivel mechanism comprised a liner defining a vertical centerline. An inner sleeve is disposed on the liner and the inner sleeve defines an inner sleeve recess. An outer sleeve is rotatably coupled to the inner sleeve and the outer sleeve defines an outer sleeve recess. A headsail yoke is coupled to the inner sleeve recess. A halyard yoke is coupled to the outer sleeve recess. The inner sleeve recess and the outer sleeve recess are configured to form a zero moment along the vertical centerline.

In another embodiment, the disclosed device is directed toward a furling swivel mechanism comprising a zero moment.

A method is disclosed for maintaining a zero moment for a furling swivel mechanism including an inner sleeve recess retaining a head of sail yoke and an outer sleeve recess retaining a halyard yoke. The method comprises translating a moment about the inner sleeve recess to a vertical centerline of the furling swivel mechanism. The method includes translating another moment about the outer sleeve recess to the vertical centerline of the furling swivel mechanism.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons having the benefit of this disclosure.

Figure 1:
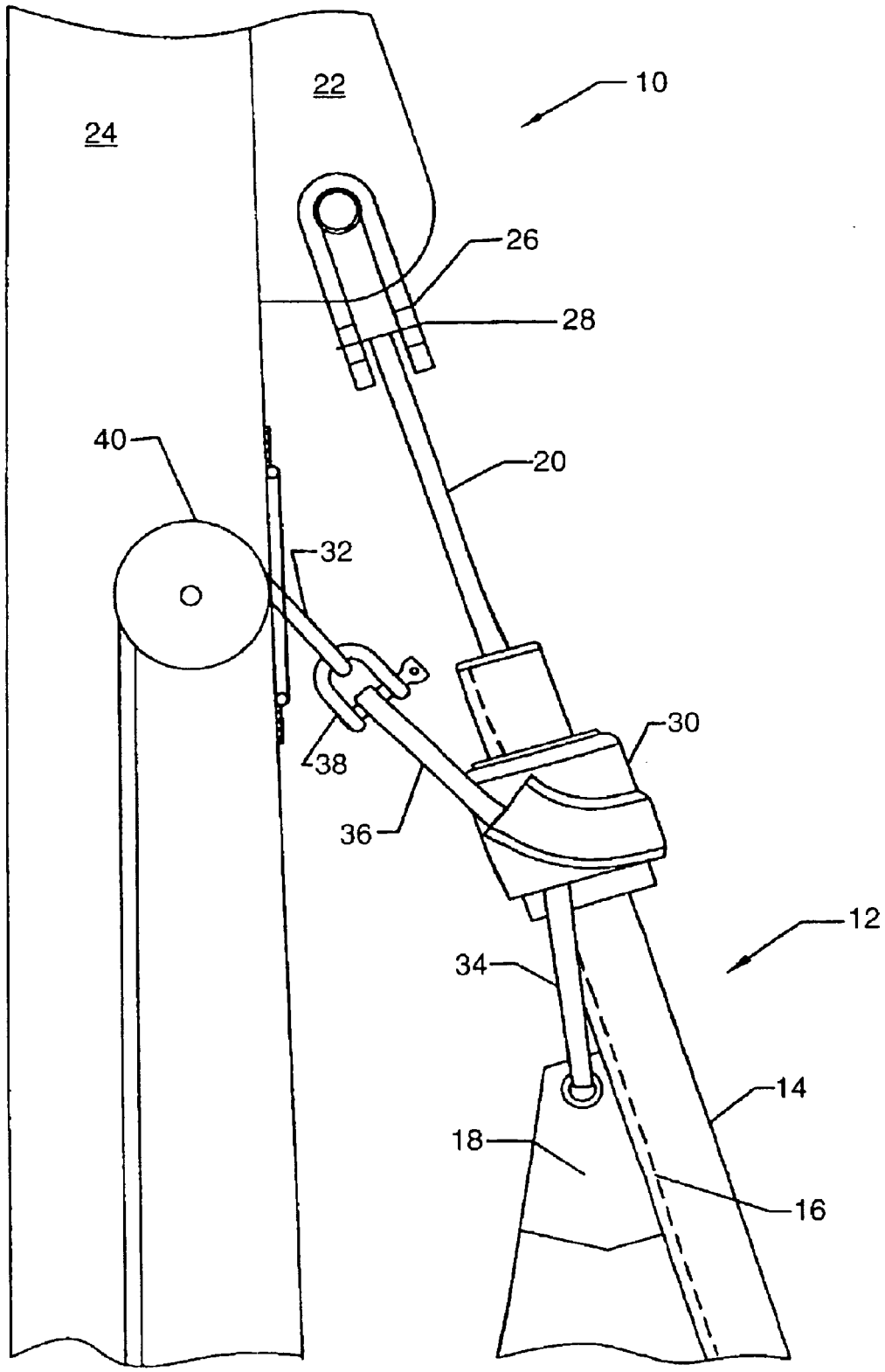
FIG. 1 illustrates the upper components of an exemplary sail system.

FIG. 1 illustrates the upper parts of a sail system 10. The sail system 10 includes a luff-groove mechanism 12 having a furling foil 14 and luff-groove 16 formed in the furling foil 14. A head of sail 18 is attached to the luff-groove 16 and held fast to the furling foil 14. A head stay 20 is disposed in the furling foil 14. The head stay 20 is coupled to a head stay lug 22 located on the uppermost portion of the mast 24. In the embodiment shown, a (toggle) jaw 26 and pin 28 attach the headstay 20 to the head stay lug 22. The sail system 10 includes a swivel mechanism 30 disposed on the top of the furling foil 14. The swivel mechanism 30 connects the head of sail 18 to a halyard 32. The swivel mechanism 30 includes a head of sail yoke 34 that couples the head of sail 18 to the swivel mechanism 30. The swivel mechanism 30 includes a halyard yoke 36 that couples the halyard 32 to the swivel mechanism 30. In the embodiment shown, a shackle 38 is coupled between the halyard 32 and the halyard yoke 36.

In operation, the sail system 10 raises and lowers the head of sail 18 by retraction of the halyard 32 around the sheave 40 in the mast 24. The head of sail 18 furls and unfurls about the luff-groove mechanism 12. The swivel mechanism 30 inhibits twisting of the halyard 32 when the head of sail 18 is furled and unfurled as well as when the head of sail 18 is being used to sail the yacht (not shown).

Figure 2:
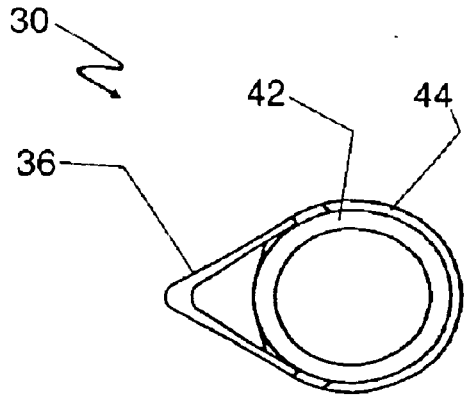
FIG. 2 is a top view of an exemplary swivel mechanism.
Figure 3:
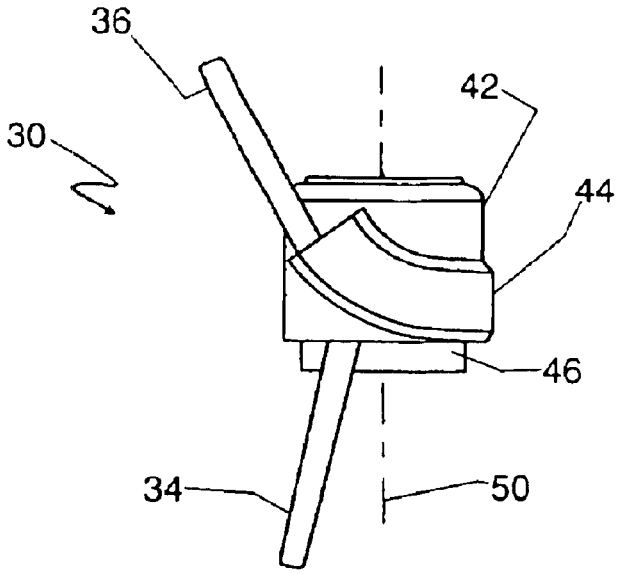
FIG. 3 is a side view of an exemplary swivel mechanism.
Figure 4:
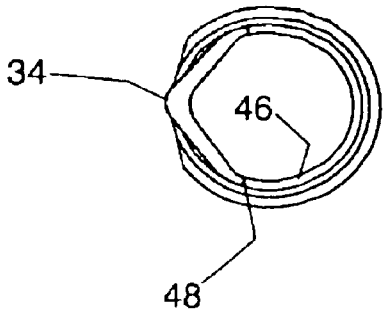
FIG. 4 is a bottom view of an exemplary swivel mechanism.

FIGS. 2, 3, and 4 illustrate an exemplary swivel mechanism 30 in a top view, side view and bottom view respectively. As illustrated in FIG. 2, the swivel mechanism 30 includes the halyard yoke 36 disposed about an outer sleeve 42 within an outer sleeve recess 44. The outer sleeve recess 44 is formed in the outer sleeve 42 and retains the halyard yoke 36, as well as distributes the forces translated through the swivel mechanism 30. As illustrated in FIG. 4, the head of sail yoke 34 is disposed about an inner sleeve 46 within an inner sleeve recess 48. The inner sleeve recess 48 is formed in the inner sleeve 46 of the swivel mechanism 30. As illustrated in FIG. 3, both the halyard yoke 36 and the head of sail yoke 34 maintain proper transfer of dynamic forces to the circumference of the swivel 30. The head of sail yoke 34 and halyard yoke 36 are semi-rigid in nature. The head of sail yoke 34 and halyard yoke 36 comprise a fiber oriented polyurethane structure, as well as metal portions. The head of sail yoke 34 and halyard yoke 36 are exceptionally strong and light weight. The head of sail yoke 34 and halyard yoke 36 are configured to be mountable in the two separate and distinct recesses (inner sleeve recess 48, outer sleeve recess 44). The configuration of the head of sail yoke 34 and halyard yoke 36 in combination with the inner sleeve recess 48, outer sleeve recess 44 respectively, function to direct all dynamic forces through the combination of the head of sail yoke 34, inner sleeve recess 48, and halyard yoke 36, outer sleeve recess 44 to the upper and lower edges of the respective recesses and ultimately to a vertical centerline 50 of the swivel mechanism 30. The result of the configuration is the absence of any moment on the swivel mechanism 30 that translates to the luff-groove mechanism 12.

Figure 5:
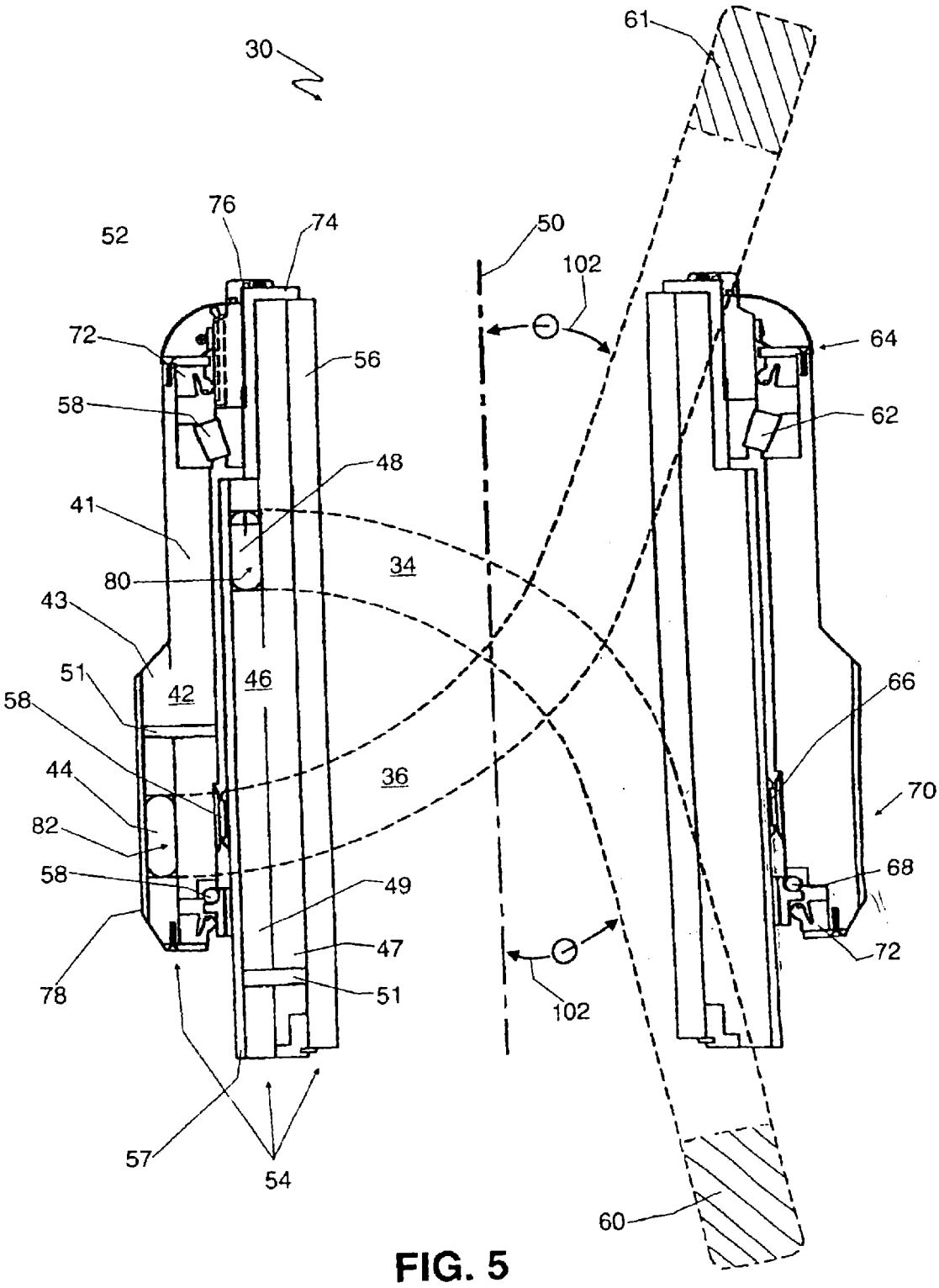
FIG. 5 is a cross section view of an exemplary swivel mechanism.

Referring to FIG. 5, a cross sectional view of an exemplary swivel mechanism 30 is illustrated. The swivel mechanism 30 comprises a body 52 defined by a combination of tubes (or sleeves) 54. The sleeves 54 in one embodiment can have a length of about seven inches to about nine inches and wall thickness of about seven eighths of an inch. The swivel mechanism 30 is disposed over the furling foil 14 of the luff-groove mechanism 12 (not shown). A liner 56 is part of the body 52 located inner most on the body 52 and mountable to the luff-groove mechanism 12 (not shown). The liner 56 can be made of a synthetic formed into a tube shape to fixedly mate with the outer diameter shape of the furling foil 14. Thus, the cross sectional shape of the liner 56 can be oval, circular, elliptical, and the like. In a preferred embodiment, the liner 56 is made of a thermoplastic material such as DELRIN.

The inner sleeve 46 is disposed over the liner 56. The inner sleeve 46 comprises a carbon fiber and epoxy laminate. The inner sleeve 46 can comprise a single layer or a plurality of layers of laminate. In a preferred embodiment, the inner sleeve comprises two layers a first inner sleeve layer 47 and a second inner sleeve layer 49 reinforced by one or more fasteners 51. The inner sleeve 46 defines the inner sleeve recess 48 that retains the head of sail yoke 34. The head of sail yoke 34 couples the inner sleeve 46 to the head of sail 18 (not shown). The inner sleeve recess 48 includes an inner sleeve recess load portion 80. The inner sleeve recess load portion 80 bears the load forces from the head of sail yoke 34. In a preferred embodiment, the head of sail yoke thimble 58 can comprise metal webbing. The inner sleeve 46 and inner sleeve recess 48 are configured to translate the exterior forces acting on the inner sleeve recess load portion 80 from the head of sail 18 attached to the head of sail yoke 34 to the vertical centerline 50 on the perimeter of the inner sleeve 56. The head of sail yoke 34, in one embodiment, can include a head of sail yoke thimble 58 comprising reinforced material proximate to the coupling with the head of sail 18 (not shown).

An inner cover 57 is disposed over the inner sleeve 46. The inner cover 57 comprises a carbon fiber and epoxy laminate. The inner cover 57 retains the head of sail yoke 34 in the inner sleeve recess 48. The inner cover 57 can also provide as a mounting surface for bearings 58.

The outer sleeve 42 is disposed over the inner sleeve 46. The outer sleeve 42 comprises a carbon fiber and epoxy laminate. In a preferred embodiment, the outer sleeve 42 comprises two layers a first outer sleeve layer 41 and a second outer sleeve layer 43 reinforced by one or more fasteners 51. The outer sleeve 42 defines the outer sleeve recess 44. The outer sleeve recess 44 retains the halyard yoke 36. The halyard yoke 36 couples the outer sleeve 42 to the halyard 32 (not shown). The outer sleeve recess 44 includes an outer sleeve recess load portion 82. The outer sleeve recess load portion 82 bears the load forces from the halyard yoke 36. The outer sleeve 42 and outer sleeve recess 44 are configured to translate the exterior forces from the mast 24 (not shown) to the halyard 32 (not shown) and to the halyard yoke 36 and outer sleeve recess 44 to the outer sleeve recess load portion 82 which translates the load to the swivel mechanism's vertical centerline 50. The halyard yoke 36, in one embodiment, can include a halyard yoke thimble 61 comprising reinforced material proximate to the coupling with the halyard 32 (not shown). In a preferred embodiment, the halyard yoke thimble 61 can comprise metal webbing.

In another embodiment, the bearings 58 are disposed between the inner sleeve 46 and the outer sleeve 42. A variety of types of bearings 58 can be employed to facilitate the rotation between the inner sleeve 46 and the outer sleeve 42. FIG. 5 illustrates a tapered roller bearing 62 disposed proximate to an upper section 64 of the swivel mechanism 30. Roller bearings 66 and ball bearings 68 can be disposed proximate to a lower section 70 of the swivel mechanism 30. A seal 72 can be disposed between the inner sleeve 46 and the outer sleeve 42 to prevent foreign matter from fouling the rotation of the inner sleeve 46 and the outer sleeve 42. A spacer 74 and a retainer 76 can be coupled between the inner sleeve 46 and the outer sleeve 42 to maintain the alignment of the inner sleeve 46 and the outer sleeve 42. In one embodiment, the spacer 74 and retainer 76 are threadably coupled.

An outer cover 78 is disposed over the outer sleeve 42. The outer cover 78 comprises a carbon fiber and epoxy laminate. The outer cover 78 retains the halyard yoke 36 in the outer sleeve recess 44.

Figure 6:
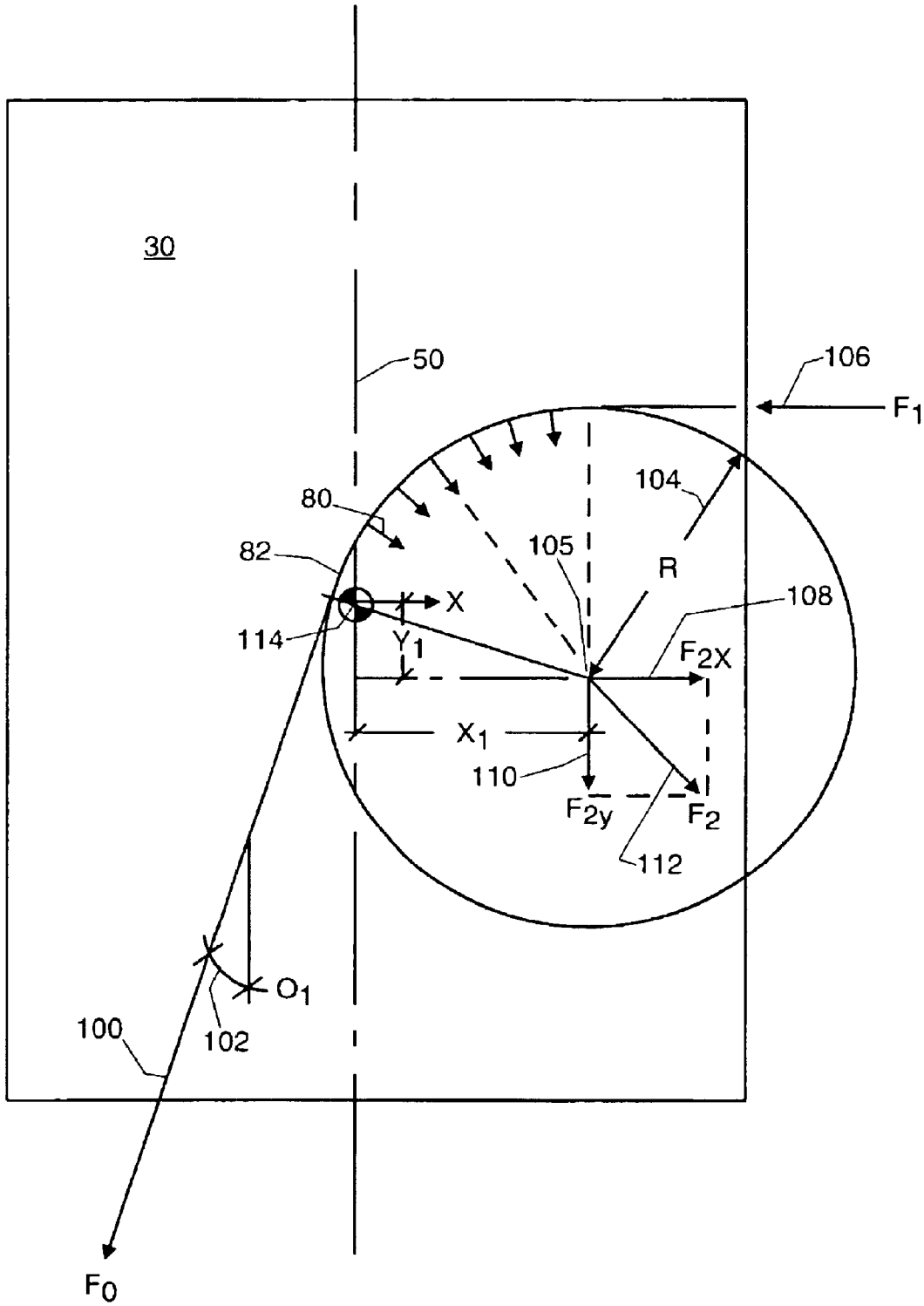
FIG. 6 is a schematic of the relationship of the loading forces applied to an exemplary swivel mechanism is illustrated.

Referring to FIG. 6, a schematic of the relationship of the loading forces applied to the swivel mechanism 30 is illustrated. FIG. 6 illustrates a two dimensional projection of the forces caused by the loads on the swivel mechanism 30. The swivel mechanism 30 is shown in schematic form including the vertical centerline 50 of the swivel mechanism 30. By configuring the inner sleeve recess 48 having the inner sleeve recess load portion 80 in cooperation with the head of sail yoke 34, the load from exterior forces can be transferred such that the moment from the load forces lies at the vertical centerline 50. Additionally, by configuring the outer sleeve recess 44 having the outer sleeve recess load portion 82 in cooperation with the halyard yoke 36, the load from exterior forces can be transferred such that the moment from the load forces centers at the vertical centerline 50. With the moments developed by the external load forces transferred to the vertical centerline 50 of the swivel mechanism 30, the swivel mechanism is no longer subjected to racking about the vertical centerline 50, this can be defined as a zero moment along the vertical centerline. A zero moment means that the swivel mechanism translates the forces and the moments resulting from those forces to the vertical centerline 50 of the swivel mechanism 30.

As illustrated in FIG. 6 the schematic has a force arrow 100 representing the external force Fo from a load. The force Fo can be the force due to load on the head of sail yoke (not shown) or the halyard yoke (not shown). The angle theta 102 represents the angle θ of the halyard yoke to the centerline 50 or the angle of the head of sail yoke (not shown) to the centerline 50. The radius 104 represents the radius R from a geometric center 105 of the inner sleeve recess to the inner sleeve recess load portion 80 or the radius from a geometric center 105 of the outer sleeve recess to the outer sleeve recess load portion 82. The force arrow 106 represents the external force $F_1$ acting on the swivel mechanism 30 perpendicular to the vertical centerline 50. The force arrow 108 represents the force $F_{2x}$ in the x direction through the center 105. The force arrow 110 represents the force $F_{2y}$ in the y-direction through the center 105. The force arrow 112 represents the force vector $F_2$ having components of $F_{2x}$ and $F_{2y}$ from the load portion 80, 82 through the center 105. The center mark 114 represents the center of moment as translated to the vertical centerline 50. The distances $X_1$ and $Y_1$ represent the distances in the X and Y directions of the center of moment 114 from the geometric center 105. The relationship of moments about the swivel mechanism can be expressed in the following equations:

For a given angle theta, ($X_1$, $Y_1$, and R) can be arranged such that the sum of the Moments of theta equals 0.

$$M_1=F_1(Y_1+R)$$

$$M_{2x}=F_{2x}(Y_1)$$

$$M_{2y}=F_{2y}(X_1);$$

Wherein the first moment is $M_1$ and the second moment in the x-direction is $M_{2x}$ and the second moment in the y-direction is $M_{2y}$.

In operation, the crossing over of the halyard yoke 36 with the head of sail yoke 34, with each moment residing on the vertical centerline 50 of the swivel mechanism 30 functions to cancel the moments potentially created by the extreme loads being supported in the sail system 10. By canceling the moments applied to the individual head of sail yoke 34 and individual halyard yoke 36, the combined swivel mechanism is capable of supporting extreme loads in the absence of racking or moment, i.e., zero moment. The luff-groove mechanism 12 is thus protected from damage. As the luff-groove mechanism 12 rotates in response to furl or unfurl the sail, the liner 56 and the inner sleeve 46 rotate with the luff-groove mechanism 12. The outer sleeve 42 remains relatively stationary with respect to the liner 56 and inner sleeve 46, since the outer sleeve 42 is held fast by the halyard 32. Thus, as the sail is furled or unfurled, the halyard 32 is unaffected by the rotation of the head of sail 18. Therefore, the halyard 32 does not twist or rotate avoiding the wear mechanisms that lead to failure of the halyard 18.

The disclosed mechanism enables all loads and dynamic forces to be directed to the vertical center of the swivel device. The disclosed mechanism allows for fluid and smooth furling and unfurling of the sail, while maintaining structural integrity under the load of tremendous forces driven through the swivel mechanism.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A furling swivel mechanism comprising:

a liner defining a vertical centerline;

an inner sleeve disposed on said liner, said inner sleeve defining an inner sleeve recess, wherein said inner sleeve includes an inner sleeve recess load portion defined by a radius about a geometric center;

an outer sleeve rotatably coupled to said inner sleeve, said outer sleeve defining an outer sleeve recess, wherein said outer sleeve includes an outer sleeve recess load portion defined by another radius about another geometric center;

a headsail yoke coupled to said inner sleeve recess;

a halyard yoke coupled to said outer sleeve recess; and said inner sleeve recess and said outer sleeve recess configured to form a zero moment along said vertical centerline.

2. The furling swivel mechanism of claim 1 wherein said inner sleeve zero moment being configurable by varying a location of said center and by varying a length of said radius for a predetermined head of sail yoke angle.

3. The furling swivel mechanism of claim 1 wherein said outer sleeve zero moment being configurable by varying a location of said another geometric center and by varying a length of said another radius for a predetermined halyard yoke angle.

4. The furling swivel mechanism of claim 1 wherein said inner sleeve comprises a first inner sleeve layer and a second inner sleeve layer disposed on said first inner sleeve layer.

5. The furling swivel mechanism of claim 1 wherein said outer sleeve comprises a first outer sleeve layer and a second outer sleeve layer disposed on said first outer sleeve layer.

6. The furling swivel mechanism of claim 1 further comprising:

an inner cover disposed over said inner sleeve and an outer cover disposed over said outer sleeve.

7. The furling swivel mechanism of claim 1 further comprising:

at least one bearing disposed between said inner sleeve and said outer sleeve configured for rotary coupling of said inner sleeve and said outer sleeve.

8. The furling swivel mechanism of claim 1 wherein said head of sail yoke includes a head of sail yoke thimble and said halyard yoke includes a halyard yoke thimble.

9. The furling swivel mechanism of claim 1 wherein said inner sleeve includes an inner sleeve recess load portion configured to support said head of sail yoke and said outer sleeve recess includes an outer sleeve recess load portion configured to support said halyard yoke.

10. A method of maintaining a zero moment for a furling swivel mechanism including an inner sleeve recess retaining a head of sail yoke and an outer sleeve recess retaining a halyard yoke, the method comprising:

translating a moment about the inner sleeve recess to a vertical centerline of the furling swivel mechanism;

altering an inner sleeve recess shape and an inner sleeve recess location relative to said vertical centerline for a predetermined head of sail angle, said inner recess location definable by a radius about a geometric center of said inner sleeve recess, said inner sleeve recess shape definable by a dimension of said radius;

translating another moment about the outer sleeve recess to said vertical centerline of the furling swivel mechanism; and altering an outer sleeve recess shape and an outer sleeve recess location relative to said vertical centerline for a predetermined halyard angle, said outer recess location definable by a radius about a geometric center of said outer sleeve recess, said outer sleeve recess shape definable by a dimension of said radius.

11. The method of claim 10 wherein said moment about the inner sleeve recess includes the forces from a head of sail yoke at a head of sail yoke angle acting on an inner sleeve recess load portion.

12. The method of claim 10 wherein said anther moment about the outer sleeve recess includes the forces from a halyard yoke at a halyard yoke angle acting on an outer sleeve recess load portion.

* * * * *